United States Patent [19]

Young

[11] Patent Number: 4,760,795

[45] Date of Patent: Aug. 2, 1988

[54] EXPLOSIVE PROJECTILES

[75] Inventor: Frederick M. Young, Chorley, England

[73] Assignee: Royal Ordnance plc, London, England

[21] Appl. No.: 915,757

[22] Filed: Oct. 6, 1986

[30] Foreign Application Priority Data

Oct. 22, 1985 [GB] United Kingdom ..... 8526048

[51] Int. Cl.[4] ..... F42B 11/22

[52] U.S. Cl. ..... 102/473; 102/293; 102/499; 86/20.14

[58] Field of Search ..... 102/473, 491, 499, 500, 102/272, 275, 293, 474, 475, 477–482, 486–489; 277/205, 123, 125, 234, 235 R, DIG. 6; 86/20.14; 29/1.2–1.23

[56] References Cited

U.S. PATENT DOCUMENTS

| | | | |
|---|---|---|---|
| 602,092 | 4/1898 | McKeone | 102/479 |
| 633,458 | 9/1899 | Jared | 102/500 |
| 2,867,457 | 1/1959 | Riesing et al. | 277/205 X |
| 3,146,683 | 9/1964 | Hoffmann | 277/205 X |
| 3,159,076 | 12/1964 | Meissner | 86/20.14 |
| 3,883,162 | 5/1975 | Calburn | 277/205 |
| 4,414,902 | 11/1983 | Strasser et al. | 102/531 |

FOREIGN PATENT DOCUMENTS

| | | | |
|---|---|---|---|
| 497644 | 3/1956 | Italy | 102/473 |
| 10980 | 8/1884 | United Kingdom | 102/479 |

*Primary Examiner*—Harold J. Tudor
*Attorney, Agent, or Firm*—Stevens, Davis, Miller & Mosher

[57] ABSTRACT

An explosive projectile comprises a projectile casing, a high explosive charge filling a portion of the space inside the casing, an impervious case defining a detonation device cavity adjacent to a surface of the explosive charge, and located adjacent to the said surface of the explosive charge between the inside wall of the projectile casing and the impervious case, a pre-formed solid elastic sealant ring such that the seal effected by the sealant ring between the projectile casing and the impervious case is tightened if the pressure on the sealant ring from the material of the explosive charge increases.

18 Claims, 4 Drawing Sheets

EXPLOSIVE PROJECTILES

The present invention relates to explosive projectiles.

It has been known for many years to manufacture high explosive projectiles which comprise a type of gun-fired shell in various ways, one of which is that described as follows. A metal casing having an open upper end and a closed lower end forming a container is partially filled with high explosive material in a hot liquid state which is allowed to solidify by cooling or by pressing powder into a solid state inside the casing. A detonator booster cavity is later machined in the upper surface of the solid explosive charge so formed into which is inserted a cardboard liner, projecting above the charge.

The gap above the explosive charge between the wall of the casing and the liner of the booster cavity is then sealed with a bituminous composition which is applied in a soft mastic state and kneaded by a hand worked operation to occupy the corners of the gap and to adhere to and coat the adjoining surfaces of the casing, the liner and the explosive charge.

A detonator booster device is inserted in the cavity. Finally, the open upper end is closed by a fuze which in operation interacts with the booster device to provide the required detonation of the explosive charge.

During their service life high explosive shells may be subjected to extreme environmental conditions, particularly high and low temperatures, and rough use eg drop, bounce, vibration, topple etc. These conditions can cause the explosive charge to crack and powder. High temperatures can cause expansion and even melting of the charge. The bituminous composition seal is applied as described above to seal in the explosive charge to prevent it being contaminated by atmospheric moisture and other substances and to prevent the explosive material entering the fuze cavity region.

Explosive charge material entering this region is regarded as a serious safety hazard. The fuze is normally fitted in the shell casing by a screw thread joint. If the explosive charge material becomes trapped between the threads of the fuze screw thread joint it may be initiated by (a) removing the fuze (eg for inspection purposes) or (b) acceleration of the shell on firing which can cause compression of the explosive material between the screw threads. Such initiation can cause uncontrolled premature detonation of the main explosive charge.

Explosive shells manufactured by the known method described above suffer from serious sealing problems. It has been found that the bituminous sealant material does not adequately contain the explosive material in all circumstances.

In cold conditions the bituminous material becomes very brittle and the seal is likely to crack and break down allowing explosive material to escape. The sealant particles themselves are a hazard since the friction caused by their relative movement could itself trigger an unwanted detonation. In hot conditions the sealant material softens and fails to contain the explosive material in some cases. It has been found, for instance, that a known explosive composition containing TNT and RDX, which starts to soften at about 63° C. and is in a flowable state above about 73° C. exudes past the sealant material not only into the fuze cavity area but also onto the outer surface of the shell body where it is extremely hazardous. As a result, the bituminous material is unsuitable as a sealant for use over a range of climatic conditions.

Considerable effort in this field has been put into solving these problems but no satisfactory solution has been found hitherto. Much of this effort has been directed at improving the bituminous sealant material.

Another technique which has been investigated is to seal the cavity between the booster cavity liner and the casing wall with a polyurethane resin deposited in the gap in a softened uncured state to form an adhesive sealant coating similar to that of the bituminous material. This technique suffers from the disadvantages that uniform consistency of sealant polymer is difficult to achieve, access to the explosive charge, which may be necessary for inspection purposes in certain circumstances, is not easily obtained through the sealant once set and polyurethane technology is relatively dangerous because of the toxic vapours which may be produced in the chemical reactions involved in the curing process.

According to the present invention an explosive projectile comprises a projectile casing, a high explosive charge filling a portion of the space inside the casing, an impervious case defining a detonation device cavity adjacent to a surface of the explosive charge, and located adjacent to the said surface of the explosive charge between the inside wall of the projectile casing and the impervious case, a solid pre-formed elastic sealant ring such that the seal effected by the sealant ring between the projectile casing and the impervious case is tightened if the pressure on the sealant ring from the material of the explosive charge increases.

By a "high explosive" charge is meant a charge of secondary explosive material which, when initiated provides a highly energetic brisant or shattering explosive effect as distinct from, for example, a propellant effect. Charges of this kind are well known to those skilled in the art and examples of suitable known materials therefor are given below.

The term "solid" is intended to describe a ring made from a single continuous structure rather than a structure made up from a multiplicity of loosely-connected fibres etc. e.g. a felt. The ring could however comprise a composite material including embedded fibres, filler material forming a consolidated structure as well as being a ring formed from a single elastomeric material.

By "pre-formed" is meant formed before introduction into the projectile.

The present inventor has discovered that it is not necessary for the sealant to be in an adhesive state coating the adjoining surfaces of the explosive charge, the projectile casing and the detonation cavity liner (as in the known methods of manufacture), in order to effect an adequate seal for the explosive charge.

The present inventor has found that, surprisingly, use of a sealant ring as specified above in a projectile according to the present invention provides a good seal for the explosive charge under various climatic and environmental conditions and does not suffer from the problems described above. The present invention therefore provides a simple, neat and effective solution to the problem of sealing a high explosive charge in a projectile. The seal also provides an effective barrier against dust of the explosive material formed by vibration etc. of the projectile during handling.

UK Patent No. 1177813 describes the use of a non-adhesive ring made of felt located between an explosive charge and a booster device but the ring is provided for its cushioning rather than sealant effect and, because of the porosity of felt, does not adequately seal the high explosive material in a molten or vapour state or as a dust.

The projectile according to the present invention may, for example, be a gun fired explosive shell in which case the internal diameter of the casing of the shell preferably tapers inward as the casing wall projects away from the charge in the region beyond the charge, as in conventional shell casings, thereby assisting the sealing action of the sealant ring.

In the projectile according to the present invention the sealant ring is compressed into the gap between the casing and the impervious case under pressure from the explosive charge especially when the charge material expands or exudes with a rise in temperature.

The sealant ring may have any suitable cross-sectional transverse shape (as seen in a plane orthogonal to the circumference of the ring). For example, the transverse cross-sectional shape may be a solid circle or an annulus. Alternatively, the ring may have a more complex transverse cross-sectional shape. For example, it may have a bowed transverse cross-section whereby the surfaces of the ring are pressed aginst the casing wall and impervious case surfaces by action against the bow under pressure from the explosive material.

Alternatively, the transverse cross-section of the sealant ring may for instance be chevron shaped or may approximate a trapezoidal shape, a U-shape or a G-shape or an inverted V shape.

One preferred form is a cross-sectional shape approximating an inverted V in which one limb of the V, for example the inner limb with respect to the axis of the ring, is substantially parallel to the axis of the ring and the other limb is at an angle thereto.

The sealant ring may be spring assisted, eg by a metal spring. For example, where the sealant ring is approximately U-shaped or approximately G-shaped a metal spring may be used to force apart the limbs of the sealant ring against the casing and impervious case. The spring may, for example, be approximately U-shaped, inverted V-shaped or helically coiled.

The spring assistance allows the sealant material to be chosen from a wider range of candidate materials and allows emphasis to be placed upon the attribute of long life rather than a combination of life and resilience. Thus, the sealant material, with spring assistance, may be made of a long life polymeric material such as polytetrafluoroethylene at least in the regions where it contacts the casing and the impervious case. Where no spring assistance is provided the sealant ring may be made from any of the rubbery polymeric materials conventionally used as elastomeric sealant ring materials, e.g. silicone rubber.

One or more additional rings may be used in conjunction with the sealant ring. For example, a cushioning ring may be interposed between the explosive charge and the sealant ring. The cushioning ring is provided to reduce back pressure on the explosive charge and to assist containment of bulk charge movement.

The cushioning ring may comprise a soft compressible material, e.g. a felt or foam, e.g. polyurethane foam.

A metallised layer is preferably provided in conjunction with the sealant ring to act as a barrier for vapour of the explosive material. For example, a metallised ring may be provided between the explosive charge and the sealant ring.

The metallised ring which may be located above or below (relative to the front end of the projectile when pointing upward) the cushioning ring where that is included may comprise a metal-coated plastics material, e.g. aluminium coated polyester. The metallised ring may itself form the base of a ring of cup-shaped cross-section in which the cushioning ring is seated. The cup-shaped ring may be made of a plastics material, e.g. polyester coated on one or both surfaces at least on its base with metal, e.g. aluminium.

The impervious case in the projectile according to the present invention may be the liner of a cavity in which a detonation booster device is fitted. The cavity containing the case may extend into a slot previously machined in the surface of the explosive charge as in known shells. The liner may be an aluminium canister or alternatively a case made of a plastics material coated with metal, e.g. aluminium coated polyester, the metal coating being present on the inside and/or outside surface of the case at least in the portions which are adjacent to the explosive material.

The detonation device, e.g. booster, may be housed in a metal container as in known shells. The container may have tape or other cushioning material applied to its outer surface to prevent metal-to-metal contact with the said impervious case. Such contact is highly undesirable because of the dangerous friction it can cause during assembly.

The high explosive charge in the projectile according to the present invention may comprise any of the high explosive materials known for filling high explosive munitions. For example, it may comprise a conventionally used high explosive composition containing TNT (2,4,6-trinitrotoluene) and RDX (cyclo-1,3,5-trimethylene-2,4,6-trinitramine), together with one or more known additives such as HMX (cyclotetramethylenetetratranitramine), HNS (hexanitrostilbene) and beeswax.

The casing inner wall of the shell may be coated with a known lacquer or varnish to improve adhesion of the explosive material to the casing as is well known by those skilled in the art, eg as described in UK Patent No. 1,295,486.

The projectile according to the present invention, may be a gun-fired shell, eg an artillery shell, e.g. any calibre above 30 mm, e.g. 76 mm, 105 mm, 4.5 inches or especially 155 mm.

According to the present invention in another aspect a method of sealing a high explosive charge in the casing of a projectile such as a gun fired shell comprises (i) inserting a pre-formed solid elastic sealant ring through an opening of the casing and locating the ring in the space adjacent to the explosive charge and (ii) depositing an impervious case defining a detonation device cavity adjacent to the charge in the region not occupied by the sealant ring, insertion and location of the sealant ring being carried out before, during or after deposition of the impervious case so that the sealant ring occupies the space between the casing and the impervious case.

Preferably, the sealant ring is inserted and located before deposition of the impervious case to minimise distortion of the ring.

Embodiments of the present invention will now be described by way of example with reference to the accompanying drawings, in which.

Figure 1:
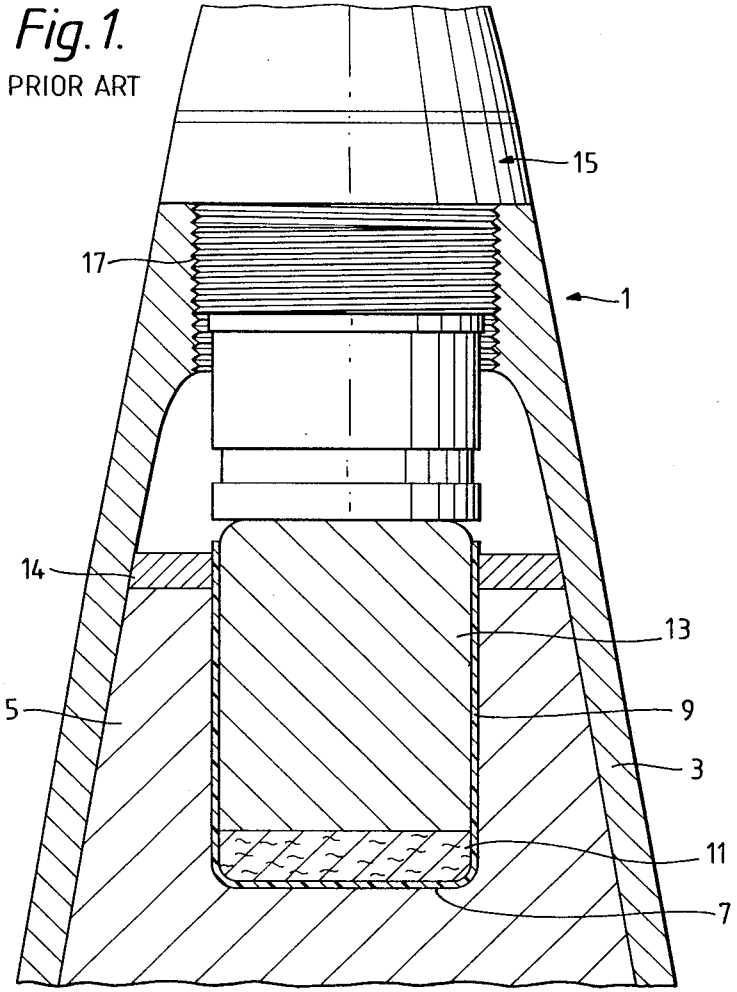
Fig. 1. PRIOR ART
FIG. 1 is a partly cross-sectional front elevation of an explosive shell of known construction.

In the prior art shell construction shown in FIG. 1, a shell 1 comprises a casing 3 made of high tensile steel partially filled with a charge of high explosive material 5 comprising the known composition manufactured according to the UK Ministry of Defence service use designation RDX/TNT Type G (CW3), a composition comprising RDX and TNT in the ratio by weight 60:40 plus additives. An aperture 7 is machined in the upper surface of the explosive material 5 and a cup shaped cardboard liner 9 is inserted in the aperture 7, the base of the liner 9 being separated from the explosive material 5 by a woollen felt layer 11. The space between the casing 3 and the liner 9 at the surface of the explosive material 5 is coated with a bituminous material 14 such as the known material having the UK Ministry of Defence service use designation RD 1284.

A booster device or exploder 13 is located in the liner 9 and finally a fuze unit 15 is screwed into the upper end of the shell 1 at a screw thread joint 17 to close that end of the shell 1.

In operation the fuze unit 15 operates to activate the booster 13 which detonates the explosive charge at the required instant in time.

The shell 1 shown in FIG. 1 has a construction which suffers from the disadvantages described above.

Figure 2:
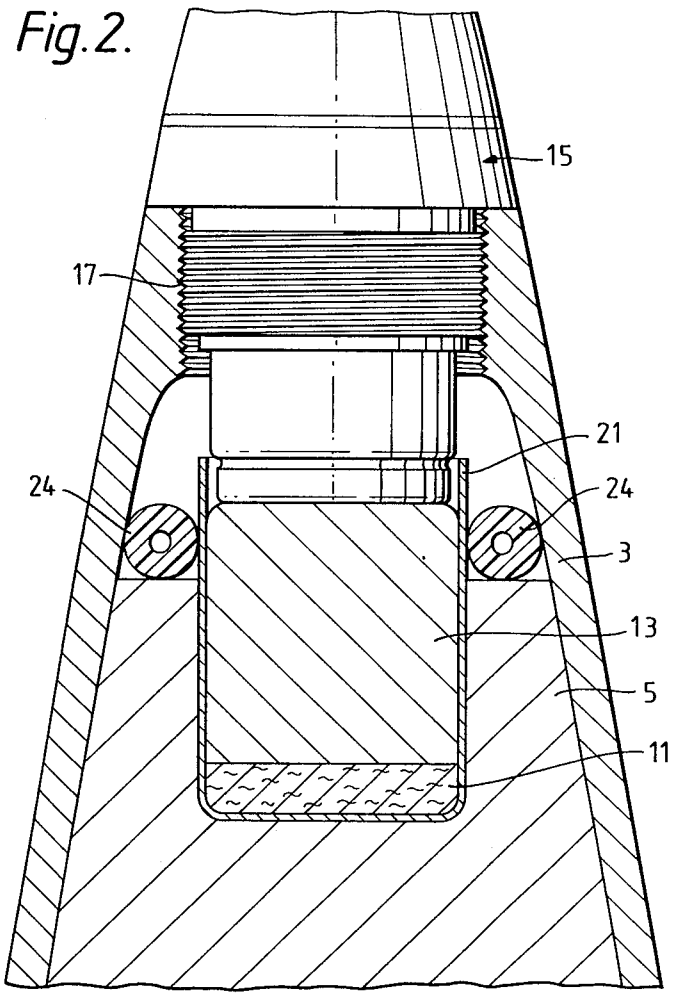
FIG. 2 is a partly cross-sectional front elevation of a portion of an explosive shell embodying the present invention.

In FIG. 2, in which parts which are the same as those in FIG. 1 are given the same reference numerals, an improved sealing construction for the shell is shown. The cardboard liner 9 is replaced by an impervious case 21 made of aluminium or an aluminium alloy. The bituminous material 14 is replaced in the FIG. 2 construction by an elastomeric sealant ring 24, e.g. made of silicone rubber, of annular transverse cross-section between the case 21 and the shell casing 3. The ring 24 is forced upward into the tapering gap between the case 21 and the shell casing 3 under pressure from the explosive material 5, e.g. during expansion or melting at high temperatures.

Figure 3:
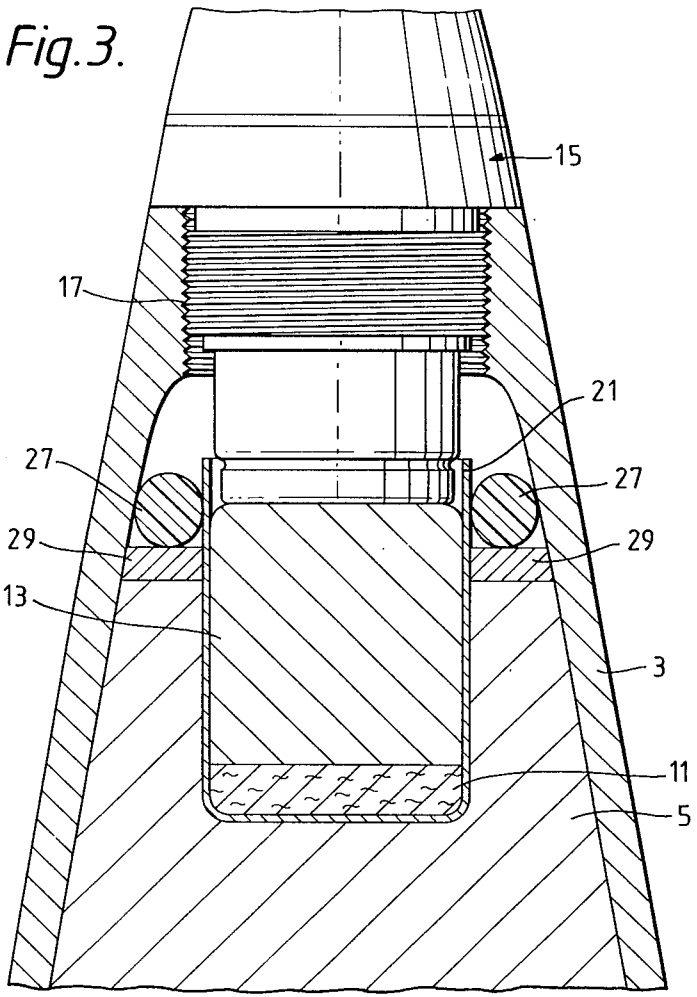

In FIG. 3, in which parts which are the same as those shown in FIG. 1 are given the same reference numerals, an alternative improved sealing construction shown. In this case the ring 24 shown in FIG. 2 is replaced by an elastomeric ring 27 of solid circular transverse cross-section. The case 21 in FIG. 3 is the same as that shown in FIG. 2.

A cushioning ring, e.g. made of felt or a foamed plastics material, may be interposed between the ring 24 shown in FIG. 2 or the ring 27 shown in FIG. 3 and the explosive material 5. This is illustrated in FIG. 3 where the cushioning ring is shown with the reference numeral 29.

Figure 4:
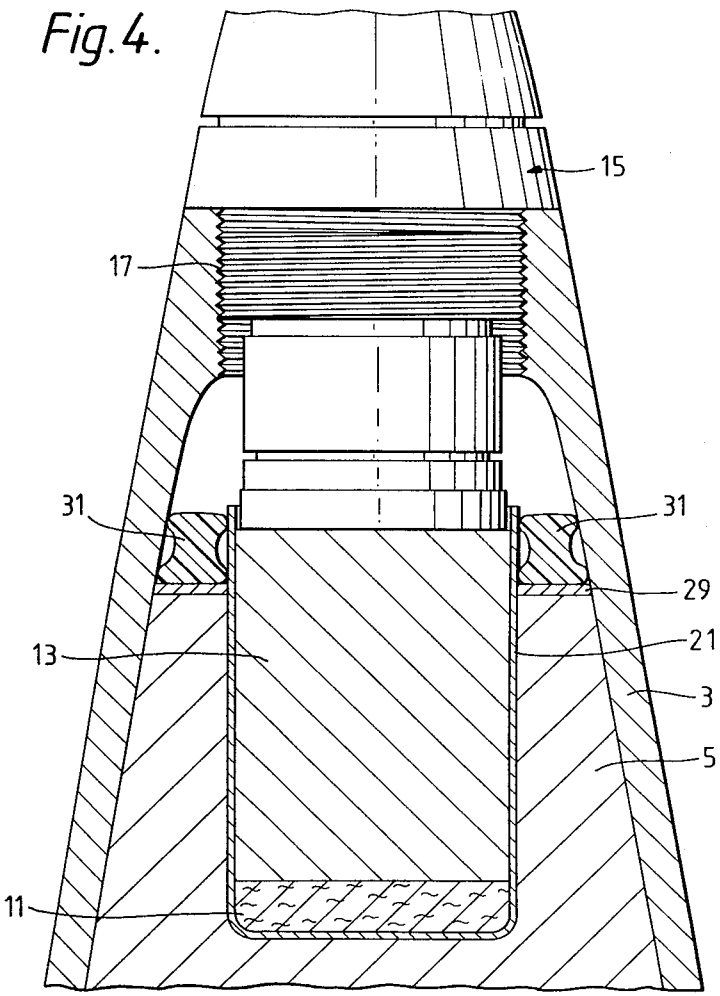
FIGS. 3 to 9 are cross-sectional front elevations of portions of various explosive shells embodying the present invention illustrating alternative sealant ring constructions.

In FIG. 4, in which parts are given the same reference numerals as in previous Figures where the parts are the same, the ring 24 shown in FIG. 2 is replaced by an elastomeric ring 31 having a transverse cross-sectional shape approximating a compressed bone shape or trapezoid.

Figure 5:
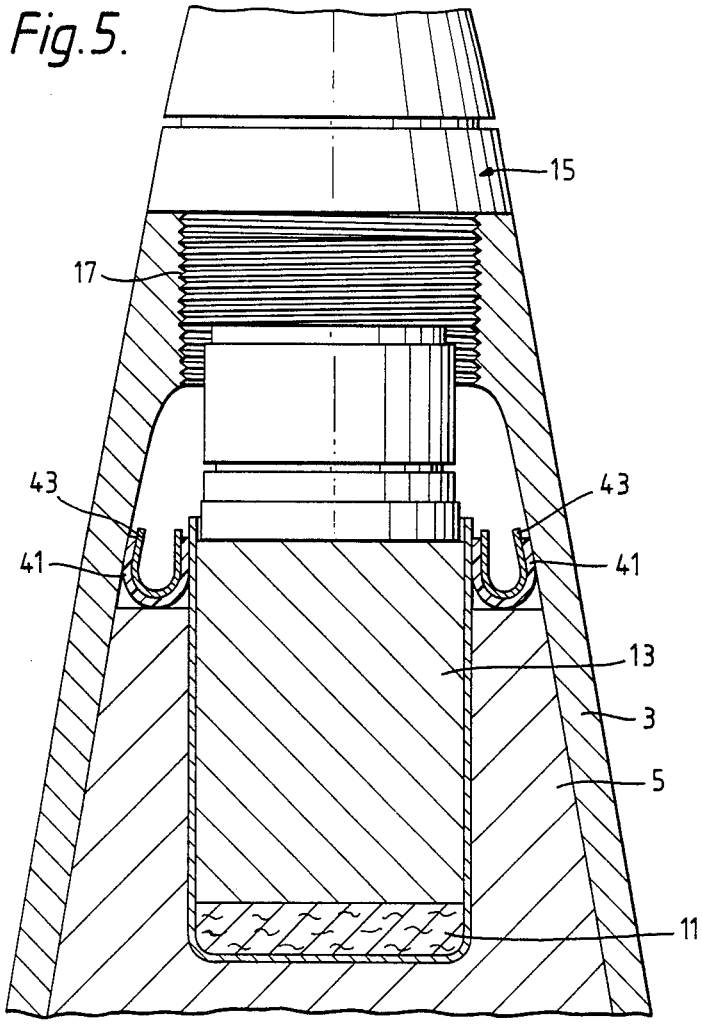

In FIG. 5, a metal spring-assisted seal is shown replacing the ring 24 of FIG. 2. The seal in FIG. 5 comprises a ring 41 of approximately U-shaped transverse cross-section and an approximately U-shaped metal portion 43 inside the limbs of the U of the ring 41 urging the limbs apart to facilitate sealing against the surfaces of the casing 3.

Figure 6:
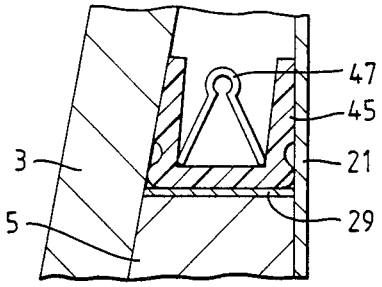
Figure 7:
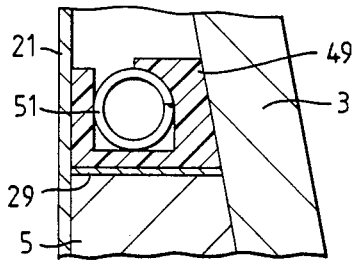

In FIGS. 6 and 7 alternative metal spring assisted seals are shown. In these cases the ring 41 and metal portion 43 of FIG. 5 are replaced respectively by (FIG. 6) an alternative sealant ring 45 of an alternative approximately U-shaped transverse cross-section together with a metal spring 47 in the form of approximately an inverted V which urges the limbs of the U of the ring 45 apart and by (FIG. 7) a sealant ring 49 of approximately G-shaped transverse cross-section the top and bottom of the G being urged apart by a coiled metal spring 51 against the case 21 and casing 3 respectively.

In the constructions shown in FIGS. 5 to 7 the rings 41, 45 and 49 respectively may be made of PTFE (polytetrafluoroethylene).

Figure 8:
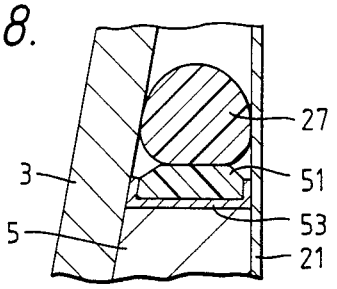

In FIG. 8, an alternative form of cushioning ring is shown (compared with that of FIG. 3). In this case the cushioning ring 29 is replaced by a composite ring comprising a foamed plastics portion 51, e.g. of expanded polyurethane deposited in a metallised portion 53 having a cup-shaped transverse cross-section, e.g. of aluminium coated polyester. The composite ring provides an additional barrier to vapour of the explosive material 5.

Figure 9:
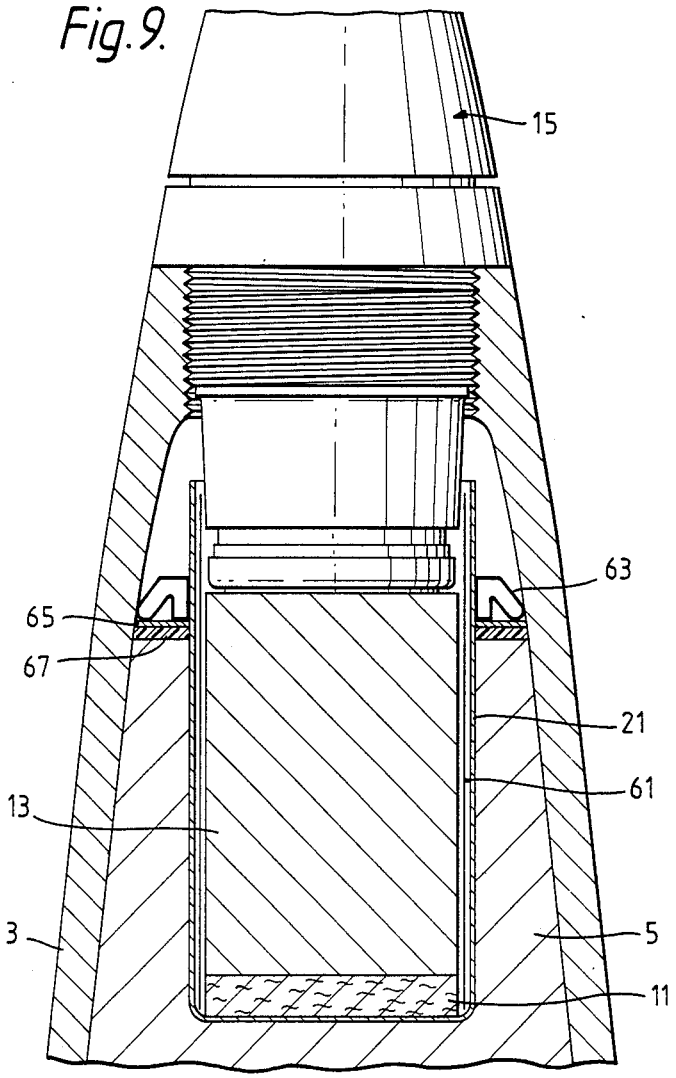

An alternative seal without a spring is shown in FIG. 9. In this case the exploder 13 is an explosive pellet separated from its aluminium alloy case 21 by a paper tube 61. The exploder 13 is again seated in the case 21 by a felt layer 11. The seal between the casing 3 and the case 21 comprises a lip sealant ring 63 deposited on a barrier washer or ring 65 comprising a surface metallised plastics material or metal eg. aluminium foil which in turn is deposited on a felt washer or ring 67. The ring 67 is deposited on the top surface of the charge 5.

In this case the sealant ring 63 comprises a cross-sectional shape approximating an inverted V having one limb parallel to the axis of the ring and the other limb at an angle thereto. The outer limb of the V makes contact with the inner wall of the casing 3. The sealant ring 63 may be made for example of a silicone rubber.

We have found that in 155 mm shells having a construction similar to that shown in FIG. 3, but having a sealant ring which was a silicone rubber O-ring of solid circular cross-section, when stored for long periods at 71° C., above the temperature at which the high explosive material began to melt, and the problem of exudation of the explosive material was substantially eliminated. Such an over-test produces gross exudation with shells of the same explosive material sealed according to the prior art method illustrated in FIG. 1.

We have found that in 105 mm shells, having a construction similar to to that shown in FIG. 9, when subjected to severe shock at low temperatures which caused break up of the filling, followed by vibration to make the dust created migrate the dust was prevented from reaching the fuze cavity. Again such an overtest would produce severe dusting in the fuze thread using the conventional design shown in FIG. 1.

I claim:

1. An explosive projectile comprising a projectile casing, a high explosive charge filling a portion of the space inside the casing, said explosive charge being of a type of material which is solid at room temperature and exudes as a flowable mass at elevated temperatures, an impervious case filling a part of said space not occupied by said exlosive charge, said impervious case defining a detonation device cavity adjacent to a surface of the explosive charge, and a pre-formed solid elastic sealant ring located adjacent to said surface of the explosive charge and extending between the inside wall of the projectile casing and the outer wall of the impervious case, said sealant ring sealing said explosive material to prevent leakage thereof along a gap between said casing and said impervious case, said casing having a shape adjacent a region at which said sealant ring is located such that a separation distance between said casing and said impervious case decreases with increasing distance away from said explosive charge, said seal effected by the sealant ring between the projectile casing and the impervious case being tightened responsive to an increase in pressure on the sealant ring from the material of the explosive charge when said material begins to exude at elevated temperatures.

2. A projectile as claimed in claim 1 and wherein the projectile is a gun fired shell, and the internal diameter of the casing of the shell tapers inward as the casing wall projects away from the charge in the region within said space beyond the charge.

3. A projectile as claimed in claim 1 and wherein the sealant ring comprises a solid ring comprising elastomeric material and has a transverse cross-section comprising a solid circle or an annulus.

4. A projectile as claimed in claim 1 and wherein the sealant ring has a transverse cross-sectional shape selected from a chevron shape, a bow shape, an approximate trapezoidal shape, an approximate U-shape or an approximate G-shape.

5. A projectile as claimed in claim 1 and wherein the sealant ring comprises a lip seal having a transverse annular cross-section approximating an inverted V in which the limb of the V nearer the axis of the ring is substantially parallel to the axis of the ring and the other limb of the V is at an angle thereto.

6. A projectile as claimed in claim 1 and wherein the sealant ring is spring assisted.

7. A projectile as claimed in claim 6 and wherein the sealant ring has a transverse cross-section which approximates a U-shape and the spring assistance is provided by a metal spring having a transverse cross-section approximating a U-shape inside the approximate U of the ring.

8. A projectile as claimed in claim 6 and wherein the sealant ring has a transverse cross-section which approximates a U-shape and the metal spring has a transverse cross-section which approximates an inverted V-shape inside the approximate U of the ring.

9. A projectile as claimed in claim 6 and wherein the sealant ring has a transverse cross-section which approximates a G-shape and the spring is a metal coil contained within the limbs of the approximate G.

10. A projectile as claimed in claim 6 and wherein the sealant ring is made of a long life polymeric material.

11. A projectile as claimed in claim 1 and wherein the projectile includes a metallised ring in conjunction with the sealant ring.

12. A projectile as claimed in claim 11 and wherein the metallised ring comprises a metal coated plastics material.

13. A projectile as claimed in claim 11 and wherein the metallised ring comprises an aluminium coated polyester ring..

14. A projectile as claimed in claim 1 and wherein a cushioning ring is located between the sealant ring and the explosive charge.

15. A projectile as claimed in claim 14 and wherein the cushioning ring is located in a ring of metal coated plastics material having a cup-shaped transverse cross-section.

16. A method of sealing a high explosive charge located in an explosive projectile which comprises a projectile casing, a high explosive charge filling a portion of the space inside the casing, said explosive charge being of a type of material which is a solid at room temperature and exudes as a flowable mass at elevated temperatures, an impervious case filling a part of said space not occupied by said explosive charge, said impervious case defining a detonation device cavity adjacent to a surface of the explosive charge, and a preformed solid elastic sealant ring located adjacent to said surface of the explosive charge and extending between the inside wall of the projectile casing and the outer wall of the impervious case, said sealant ring sealing said explosive material to prevent leakage thereof along a gap between said casing and said impervious case, said casing having a shape adjacent a region at which said sealant ring is located such that a separation distance between said casing and said impervious case decreases with increasing distance away from said explosive charge, said seal effected by the sealant ring between the projectile casing and the impervious case being tightened responsive to an increase in pressure on the sealant ring from the material of the explosive charge when said material begins to exude at elevated temperatures, said method comprising (i) inserting said preformed solid elastic sealant ring through an opening of the casing and locating the ring in the space adjacent to the explosive charge and (ii) depositing said impervious case defining said detonation device cavity adjacent to the charge in the region within said casing not occupied by the sealant ring, insertion and location of the sealant ring being carried out in a step occurring one of (a) before, (b) during and (c) after deposition of the impervious case so that the sealant ring occupies said space.

17. A method as claimed in claim 16 and wherein the sealant ring is inserted and located prior to deposition of the impervious case.

18. A method as claimed in claim 16 and wherein the impervious case is deposited in an aperture provided in the surface of the explosive charge inside the projectile to locate the case in position.

* * * * *